United States Patent [19]

Ninomiya

[11] Patent Number: 4,972,902

[45] Date of Patent: Nov. 27, 1990

[54] TRIPLE-WALL TUBE HEAT EXCHANGER

[75] Inventor: Susuma Ninomiya, Yokohama, Japan

[73] Assignee: Kabushiki Kaisha Toshiba, Kawasaki, Japan

[21] Appl. No.: 303,192

[22] Filed: Jan. 30, 1989

Related U.S. Application Data

[63] Continuation-in-part of Ser. No. 79,469, Jul. 30, 1987, abandoned.

[30] Foreign Application Priority Data

Sep. 5, 1986 [JP] Japan ..... 61-209061
Dec. 17, 1986 [JP] Japan ..... 61-300751

[51] Int. Cl.[5] ..... F28F 1/00; F28F 23/00

[52] U.S. Cl. ..... 165/70; 165/11.1; 165/154

[58] Field of Search ..... 165/11.1, 70, 154, 158

[56] References Cited

U.S. PATENT DOCUMENTS 3,850,231 11/1974 Creek ..... 165/83
4,090,554 5/1978 Dickinson ..... 165/1
4,182,407 1/1980 Lagerwerf et al. ..... 165/70
4,245,696 1/1981 Van der Lelij ..... 165/134.1

FOREIGN PATENT DOCUMENTS 259895 3/1988 European Pat. Off. ..... 165/70
637898 11/1936 Fed. Rep. of Germany ..... 165/154
1117148 11/1961 Fed. Rep. of Germany ..... 165/70
732204 6/1955 United Kingdom ..... 165/70

*Primary Examiner*—Alan Cohan
*Assistant Examiner*—Allen J. Flanigan
*Attorney, Agent, or Firm*—Foley & Lardner, Schwartz, Jeffery, Schwaab, Mack, Blumenthal & Evans

[57] ABSTRACT

A shell-and-tube exchanger for generating steam, comprising triple-wall tubes, each trible-wall tube including an inner tube, an outer tube and an intermediate porous layer of practically same length. The porous layer is connected to a leak detector for detecting leakage in the triple-wall tube. The triple-wall tubes penetrate and are welded to four tube sheets which define in the shell, steam outlet plenum, upper gas plenum, sodium plenum, lower gas plenum and water inlet plenum. The outer tubes have side holes in the gas plena, which communicate the gas plena to the intermediate porous layer.

3 Claims, 3 Drawing Sheets

TRIPLE-WALL TUBE HEAT EXCHANGER

CROSS-REFERENCE TO RELATED APPLICATION

This application is a continuation-in-part of copending application Ser. No. 079,469, filed July 30, 1987, now abandoned.

BACKGROUND OF THE INVENTION

1. Field of the Invention

This invention relates generally to a heat exchanger, and more particularly to a shell-and-tube heat exchanger including triple-wall heat-conducting tubes.

2. Description of the Prior Art

A conventional fast breeder reactor plant includes steam generators, where water in metal tubes is heated and boiled by heat transferred from hot liquid metal outside of the tubes in a shell. The liquid metal gains heat in a reactor vessel, while the steam produced in the steam generators is used to generate electric power in turbine generators.

If the tube wall segregating the water from the liquid metal has a defect and the water leaks into the liquid metal, and if the liquid metal is sodium, as usually is the case, the liquid metal and the water will react explosively. In order to avoid such an incident, shell-and-tube heat exchangers using double-wall tubes have been developed, as shown in pages 60 through 87, pages 270 through 279 and pages 280 through 288, of *Nuclear Technology* Vol. 55, Nov. 1981.

In the double-wall tube steam generators disclosed in the above references, high pressure water flows in inner tubes, and sodium flows outside of outer tubes in a shell. There are small gaps between the inner tubes and the outer tubes, and the gaps are connected to a gas plenum or a monitoring chamber. If there is a defect in the inner tube, the water or steam flows into the gap and then into the gas plenum, which can be detected. If there is a defect in the outer tube, the gas in the gas plenum flows into the sodium in the shell, and the gas plenum pressure decreases, which can be detected.

The gaps should be large enough for the leakage particles to diffuse rapidly in order to induce a rapid response by the detector. However, since the gaps hinder heat transfer, the double-wall tubes with gaps require a large heat transfer area, which results in large and expensive heat exchangers. Besides, the inner tubes and the outer tubes must be metallurgically separated in order to avoid cracks in the inner tubes expanding into the outer tubes, or vice versa. Furthermore, the size of the gaps cannot be controlled, because they change due to heat expansions of the inner and outer tubes.

The outer tubes disclosed in the above-mentioned references have grooves in the axial direction on the inner surface, to promote diffusion of the leakage particles. However, the outer tube thickness must be increased due to the grooves, which increases the heat resistance and also the cost of the tubes.

A heat exchanger including triple-wall tubes with porous intermediate layers is disclosed in German Patent Publication AUSLEGESCHRIFT 1117148. However, it is not easy to construct such a heat exchanger with the porous intermediate layers in good thermal contact with the inner and outer tubes.

SUMMARY OF THE INVENTION

An object of this invention is to provide shell-and-tube heat exchangers with highly heatconductive tubes, where defects in the tubes can be detected rapidly.

Another object of this invention is to provide shell-and-tube heat exchangers which are easily constructed.

According to the invention, there is provided a heat exchanger for generating steam, comprising: (a) a plurality of vertically arranged straight triple-wall tubes, each including: an inner tube for boiling water and permitting steam to flow upward, gaining heat; an intermediate layer of porous metal tightly abutting the inner tube; and an outer tube tightly abutting the intermediate layer; (b) a shell having liquid sodium therein, enclosing the triplewall tubes, the liquid sodium flowing downward around and providing heat to the triple-wall tubes; (c) first, second, third and fourth tube sheets arranged downward in this order, wherein the tube sheets support the triple-wall tubes and tightly define in the shell; a steam outlet plenum; an upper gas plenum; a sodium plenum; a lower gas plenum; and a water inlet plenum, stacked downward in this order; and (d) means for connecting the intermediate layers to a leak detector for detecting leakage in the triple-wall tubes; wherein: the first and fourth tube sheets are welded to the triple-wall tubes sealing the outer tubes, inner tubes and intermediate layers to each of the first and fourth tube sheets; top and bottom ends of the inner tubes are open to the steam outlet plenum and the water inlet plenum, respectively; the second and third tube sheets are seal-welded to the outer tubes; and each of the outer tubes has side holes communicating each of the gas plena to the intermediate layer.

Further objects, features and advantages of the present invention will become apparent from the detailed description of the preferred embodiments that follows, when considered with the attached drawings.

BRIEF DESCRIPTION OF THE DRAWINGS

The accompanying drawings, which are incorporated in and constitute a part of this specification, illustrate embodiments of the invention and together with the description, serve to explain the principles of the invention. In the drawings.

DETAILED DESCRIPTION OF THE PREFERRED EMBODIMENTS

Figure 1:
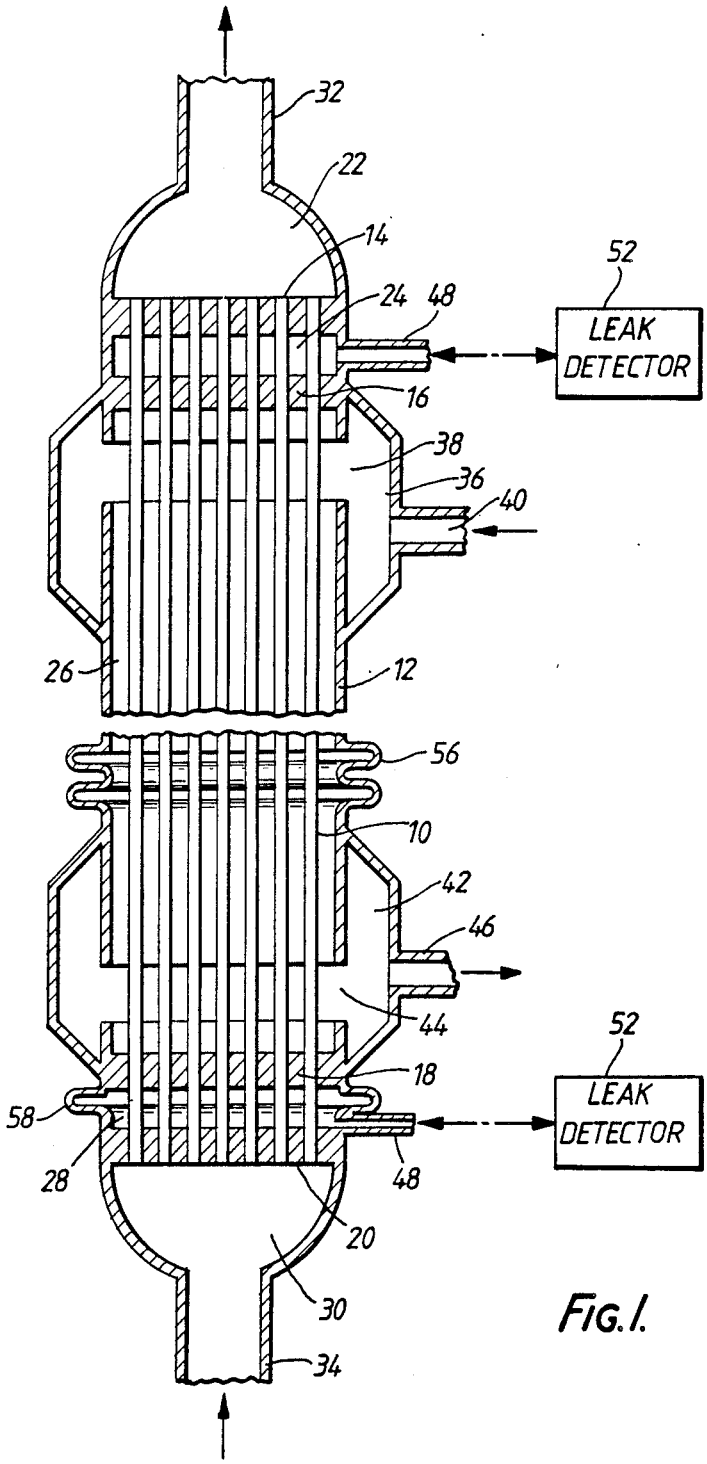
FIG. 1 is an elevational cross-sectional view of an embodiment of a steam generator of this invention.

Referring to FIG. 1, a plurality of triplewall tubes 10 are vertically arranged in a cylindrical vessel or a shell 12. The tubes 10 are supported horizontally by a steam tube sheet (first tube sheet) 14, an upper sodium tube (second tube sheet) 16, a lower sodium tube sheet (third tube sheet) 18 and a water tube sheet (fourth tube sheet) 20, in descending order.

These four tube sheets 14, 16, 18 and 20 divide the space in the shell 12 into five vertically stacked regions: a steam outlet plenum 22, an upper gas plenum 24, a sodium plenum 26, a lower gas plenum 28 and a water inlet plenum 30, in descending order. The top of the steam outlet plenum 22 is connected to a steam outlet pipe 32, and the bottom of the water inlet plenum 30 is connected to a water inlet pipe 34. An annular sodium inlet chamber 36 is formed around the shell 12 near the top end of the sodium plenum 26. The sodium inlet chamber 36 is connected to the sodium plenum 26 through a circumferential inlet opening 38. The sodium inlet chamber 30 is also connected to a sodium inlet pipe 40.

Likewise, an annular sodium outlet chamber 42 is formed around the shell 12 near the bottom end of the sodium plenum 26. The sodium outlet chamber 42 is connected to the sodium plenum 26 through a circumferential outlet opening 44. The sodium outlet chamber 42 is also connected to a sodium outlet pipe 46.

The upper gas plenum 24 and the lower gas plenum 28 are connected to leak detector pipes 48 which are connected to leak detectors 52.

The shell 12 has bellows 56 and 58 outside of the sodium plenum 26 and the lower gas plenum 28 to relieve stresses due to heat expansion.

High temperature liquid sodium heated up in a reactor vessel (not shown) is introduced through the sodium inlet pipe 40 into the sodium inlet chamber 36. The sodium then flows into the sodium plenum 26 in the shell 12 through the inlet opening 38. The sodium gives heat to the water in the tubes 10 and becomes cooler, while the sodium flows down in the shell 12. Then, the lower temperature sodium flows out through the outlet opening 44 to the sodium outlet chamber 42. Then, the sodium flows back to the reactor vessel through the sodium outlet pipe 46.

High pressure water is introduced through the water inlet pipe 34 into the water inlet plenum 30. Then, the water flows up in the tubes 10, where the water boils, gaining heat from the sodium, and becomes steam. The steam flows into the steam outlet plenum 22, and flows to the steam turbine (not shown) via the steam outlet pipe 32. The steam is used to rotate the turbine.

The gas plena 24 and 28 are filled with an inactive gas, such as nitrogen, and the pressure level is maintained between the level of the water and steam in the triple-wall tubes 10 and the level of the sodium in the shell 12.

Figure 2:
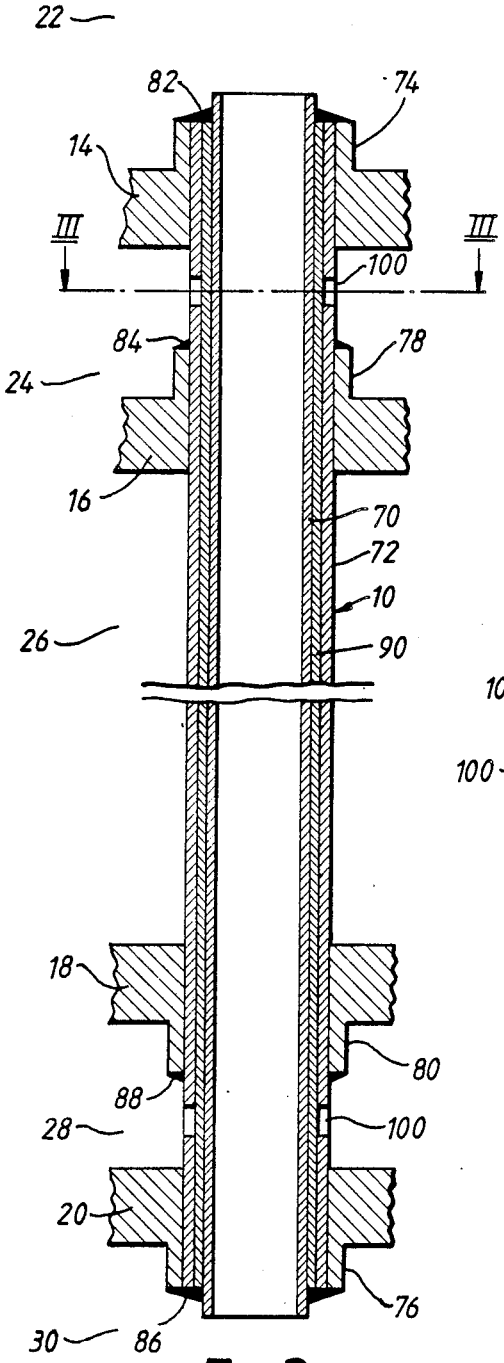
FIG. 2 is an enlarged elevational cross-sectional view of a triple-wall tube used in the steam generator of FIG. 1.

The detailed structure of the triple-wall tubes 10 is described below, referring to FIGS. 2, 3 and 4. Each of the triple-wall tubes 10 has an inner tube 70, and an outer tube 72 coaxially surrounding the full axial length of the inner tube 70 with an annular gap. The inner and outer tubes 70 and 72 are made of mechanically and chemically resistant material, such as austenite stainless steel or high-chrome steel.

The annular gap between the inner and outer tubes 70 and 72 is filled with an intermediate porous layer 90 in full length of the tubes 70 and 72. The intermediate layer 90 is made of porous metal, which may be metal fibers seamlessly interwoven, as shown in FIG. 4.

The triple-wall tubes 10 penetrate the four tube sheets 14, 16, 18 and 20. The inner tube 70, the outer tube 72 and the intermediate layer 90 are welded and sealed with a boss 74 formed on the steam tube sheet 14 and with a boss 76 formed on the water tube sheet 20. The inner tube 70 is open to the steam outlet plenum 22 and to the water inlet plenum 30 at its top and bottom ends, respectively. The outer tube 72 is welded and sealed with bosses 78 and 80 formed on the upper and lower sodium tube sheets 16 and 18, respectively.

The boss 74 on the steam tube sheet 14 and the boss 78 on the upper sodium tube sheet 16 project upward, and are welded at their top ends 82 and 84, respectively. The boss 78 on the water tube sheet 20 and the boss 80 on the lower sodium tube sheet 18 project downward, and are welded at their bottom ends 86 and 88, respectively.

The outer tube 72 has side holes 100 in the upper and lower gas plena 24 and 28. The side holes 100 communicate the gas plena 24 and 28 with the intermediate layer 90.

If there is a defect in the inner tubes 70 in the sodium plenum 26, the water and/or steam in the inner tube 70 flows into the porous intermediate layer 90, and then into the gas plena 24 and 28 through the side holes 100. The water inflow into the gas plena 24 and/or 28 is detected by the leak detectors 52 using a known chemical method or using the pressure increase in the gas plena 24 or 28.

If there is a defect in the inner tube 70 in the gas plena 24 or 28, the water and/or steam flows into the gas plena 24 or 28 directly through the side holes 100, which can be detected in the same manner, although no sodium-water reaction is expected.

If there is a defect in the outer tubes 72 in the sodium plenum 26, the gas in the gas plena 24 and 28 flows into the sodium plenum 26 through the porous layer 90 and the side holes 100. Consequently, the pressure in the gas plena 24 and 28 decreases, which is detected by a pressure transducer that is part of the leak detectors 52.

The triple-wall tube 10 is constructed as follows. The outer surface of the inner tube 70 and the inner surface of the outer tube 72 are surface treated to produce clean, smooth surfaces to get close contact with the porous layer 90.

First, the porous intermediate layer 90 is fabricated as a pipe consisting of a plurality of seamlessly, interwoven metal fibers. Such a construction of interwoven metal fibers is preferable because it is easy to construct and uniform in axial and circumferential directions. Next, porous intermediate layer 90 is positioned around the inner tube 70. Then the outer tube 72 is positioned around them. Subsequently, a conventional contraction treatment is preformed on the outside of the outer tube 72 and/or expansion treatment is performed on the inside of the inner tube 70 to form the triplewall tube 10 having a predetermined dimension. The inner tube 70, the porous intermediate layer 90 and the outer tube 72 are tightly fitted together. Then, high-temperature heat treatment is undertaken to obtain metallurgical bonding and better thermal contact on the interfaces.

After the triple-wall tubes 10 are constructed, they are inserted and positioned in the holes of the tube sheets 14, 16, 18 and 20 to be welded. Then, an expansion treatment is performed on the inner tubes 70 to obtain good sealing between the tubes 10 and bosses 74, 76, 78 and 80. Subsequently, the triple wall tubes 10 are welded to the bosses 74 and 76, and the outer tubes 72 are welded to the bosses 78 and 80.

In the embodiment described above, the heat resistance at the tube 10 is small while an adequate leakage path is secured.

Figure 3:
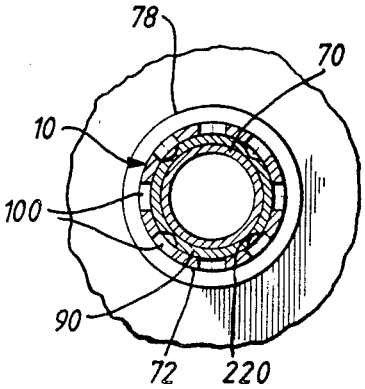
FIG. 3 is a cross-sectional view, taken along line III—III of FIG. 2.
Figure 4:
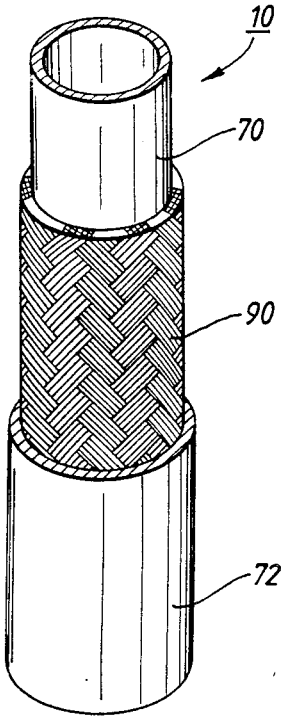
FIG. 4 is an imaginary perspective view of an exposed axial part a triple-wall tube to be used in the steam generator of FIG. 1.

The porous intermediate layer 90 may optionally have axial or helical grooves or slits to promote diffusion of the leakage gas, as shown in FIG. 3 by reference numeral 220.

Since the inner tube 70, the outer tube 72 and the intermediate layer 90 have practically same length and they are placed in the same axial position it is easy to construct each triple-wall tube 10. It would be difficult to cut the axial part of only the outer tube 72, because the intermediate layer 90 is metallurgically bonded with the inner and outer tubes 70 and 72. In addition, the triple-wall tubes 10 are mechanically strong because of this bonding.

The side holes 100 are drilled from outside of the outer tube 72. The side holes 100 must penetrate the outer tube 72 and must not reach the inner tube 70. However, it is easy to drill the side holes 100, owing to a buffer effect of the intermediate layer 90.

The foregoing description has been set forth merely to illustrate preferred embodiments of the invention and is not intended to be limiting. Since modification of the described embodiments incorporating the spirit and substance of the invention may occur to persons skilled in the art, the scope of the invention should be limited solely with respect to the appended claims and equivalents.

What is claimed is:

1. A heat exchanger for generating steam, comprising:

(a) a plurality of vertically arranged straight triple-wall tubes, each including:

an inner tube for boiling water and permitting steam to flow upward, gaining heat;

an intermediate layer of porous metal tightly abutting the inner tube wherein the intermediate layer comprises a plurality of metal fibers seamlessly interwoven; and an outer tube tightly abutting the intermediate layer;

(b) a shell for holding liquid sodium therein and enclosing said triple-wall tubes, the liquid sodium flowing downward around and providing heat to said triple-wall tubes;

(c) first, second, third and fourth tube sheets arranged downward in this order, wherein said tube sheets support the triple-wall tubes and tightly define a steam outlet plenum, an upper gas plenum, a sodium plenum, a lower gas plenum and a water inlet plenum, said plena stacked downward in this order within said shell, and (d) means for connecting the intermediate layers to a leak detector for detecting leakage in said triple-wall tubes; wherein:

said first and fourth tube sheets are welded to said triple-wall tubes and seal said outer tubes, inner tubes and intermediate layers to each of said first and fourth tube sheets;

top and bottom ends of said inner tubes are open to the steam outlet plenum and the water inlet plenum, respectively;

said second and third tube sheets are welded to said outer tubes and seal said outer tubes; and each of said outer tubes has side holes communicating each of the gas plena to said intermediate layers.

2. The heat exchanger according to claim 1, wherein each of said intermediate layers has an axial groove.

3. The heat exchanger according to claim 1, wherein each of said intermediate layers has a helical groove.

* * * * *